US006630877B2

(12) United States Patent
Manthey

(10) Patent No.: US 6,630,877 B2
(45) Date of Patent: Oct. 7, 2003

(54) ELECTROMAGNETIC CLOSING AND OPENING DEVICE FOR DOOR LEAVES THAT CAN BE PIVOTED

(76) Inventor: Sascha Manthey, Holländerstrasse 117, D-13407 Berlin (DE)

( * ) Notice: Subject to any disclaimer, the term of this patent is extended or adjusted under 35 U.S.C. 154(b) by 0 days.

(21) Appl. No.: 09/806,718

(22) PCT Filed: Dec. 21, 2000

(86) PCT No.: PCT/EP00/13106

§ 371 (c)(1),
(2), (4) Date: Apr. 4, 2001

(87) PCT Pub. No.: WO01/46545

PCT Pub. Date: Jun. 28, 2001

(65) Prior Publication Data

US 2002/0167382 A1 Nov. 14, 2002

(30) Foreign Application Priority Data

Dec. 21, 1999 (DE) ..... 199 61 893

(51) Int. Cl.[7] ..... H01H 9/00
(52) U.S. Cl. ..... 335/205; 24/303; 292/251.5
(58) Field of Search ..... 292/251.5, 144, 292/302, 74; 24/303; 335/205–7, 302–6

(56) References Cited

U.S. PATENT DOCUMENTS 2,584,480 A 2/1952 Manting
4,981,312 A * 1/1991 Frolov ..... 292/251.5
6,116,661 A * 9/2000 Overbey et al. ..... 292/92

FOREIGN PATENT DOCUMENTS

| | | |
|---|---|---|
| DE | 145325 | 12/1902 |
| DE | 4337426 | 5/1995 |
| DE | 19503863 | 8/1995 |
| DE | 19514051 | 10/1995 |
| GB | 278523 | 7/1926 |
| GB | 2085956 | 5/1982 |

* cited by examiner

*Primary Examiner*—Lincoln Donovan
(74) *Attorney, Agent, or Firm*—Norris McLaughlin & Marcus

(57) ABSTRACT

An electromagnetic device for restraining hinged door leaves in a closed position within a door frame as well as for opening hinged door leaves which are restrained in the closed position. The electromagnetic device has an electrically active part located in the door frame, and a closing counterpiece located in the hinged door leaf where upon the production of an electromagnetic field at the electrically active part a slidable counterpole piece portion of the closing counterpiece slides toward the electrically active part such that a portion of the counterpole piece engages in a free space within the door leaf thus restraining the door leaf in a closed position within the door frame.

20 Claims, 12 Drawing Sheets

Fig. 4.1
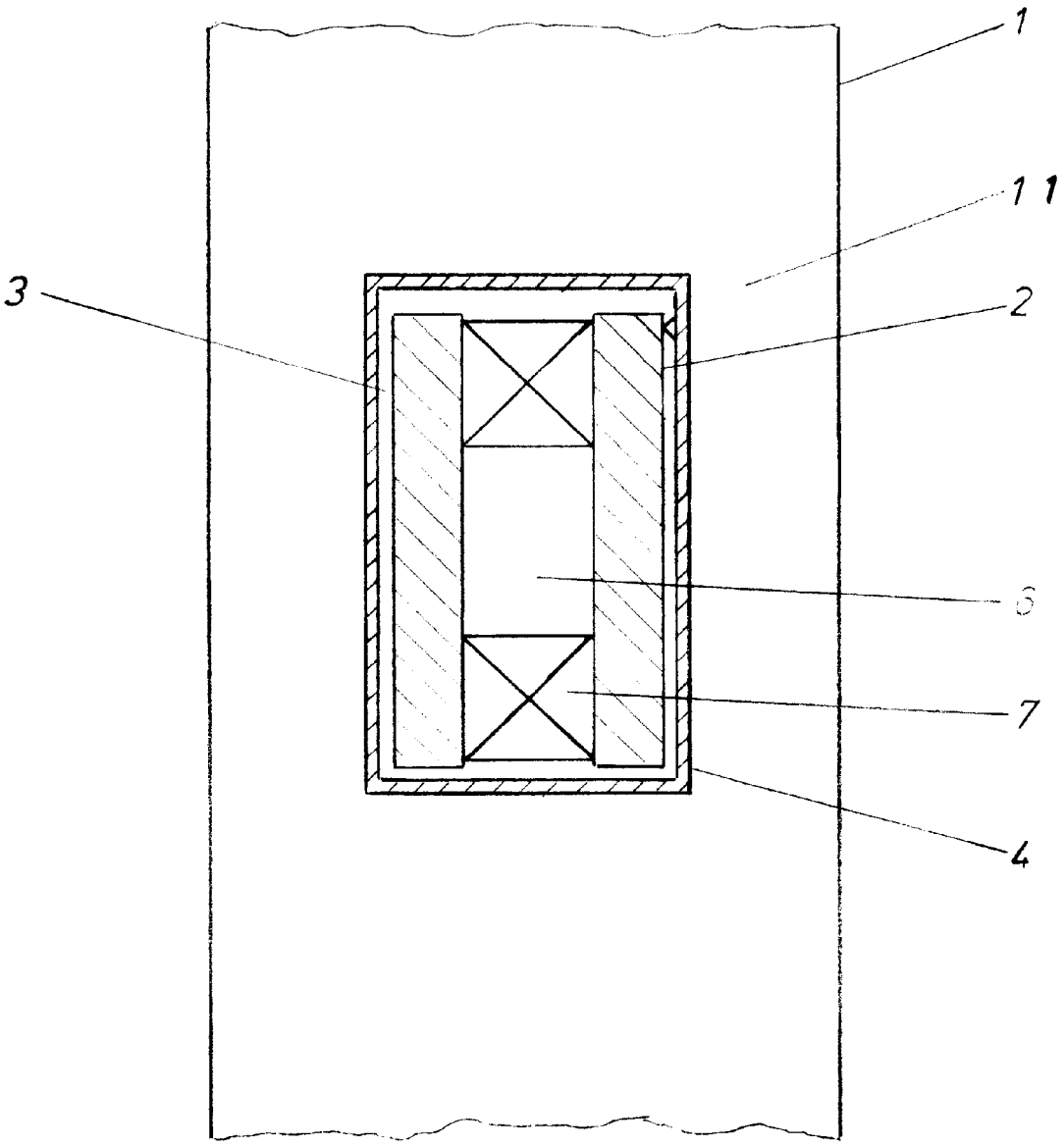

Fig. 4.2
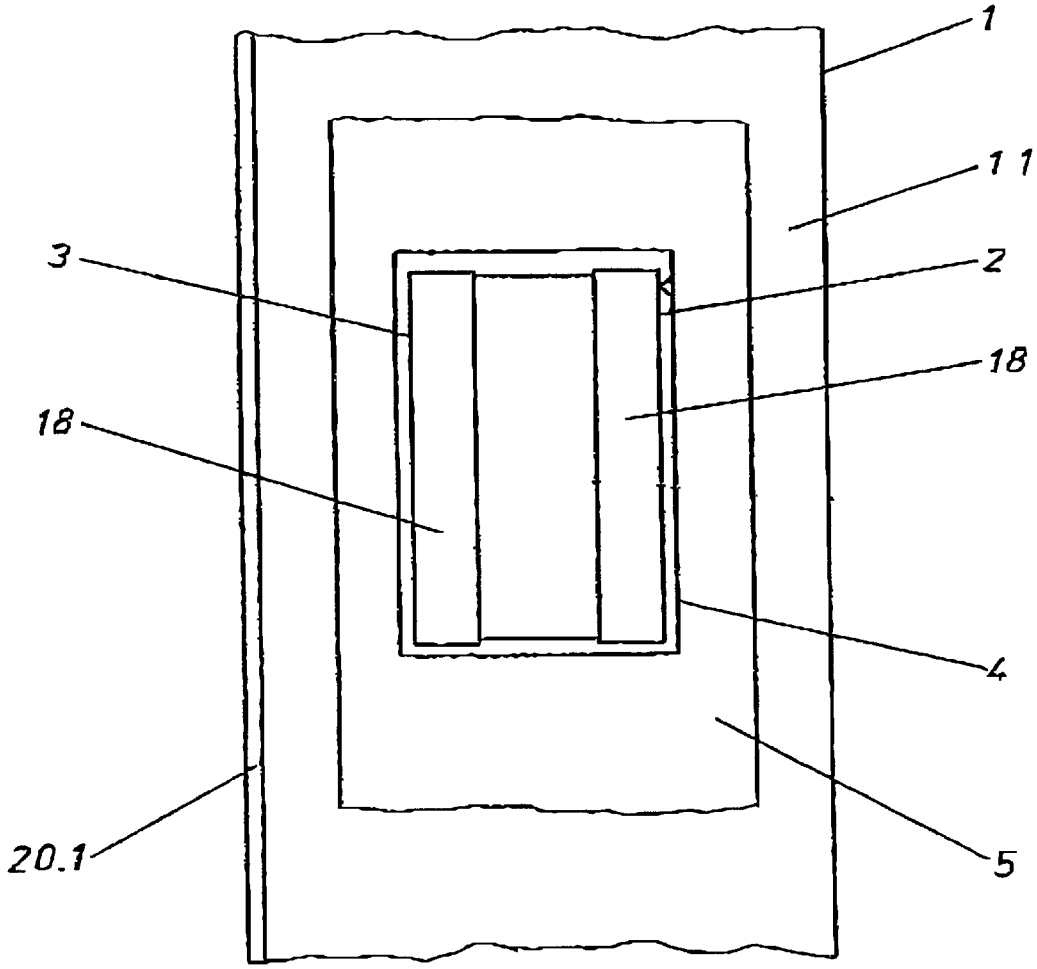

C
9
16
28
15
12
11
28
13
T
10
8.1
16
C

ELECTROMAGNETIC CLOSING AND OPENING DEVICE FOR DOOR LEAVES THAT CAN BE PIVOTED

BACKGROUND OF THE INVENTION

The invention relates to an electrically actuated device for restraining hinged door leaves in the closed position and for opening door leaves restrained in the closed position, whereby the hinged door leaves are held in the closed position by force locking.

In general, catches are known for the locking of hinged door leaves whereby a movable bolt, actuated mechanically or electromagnetically, is brought into the closed position and the movement of the hinged door leaf is hindered by form locking, whereby this closing bolt engages in a coulisse-shaped recess in the fixed doorframe or fixed door leaf.

For the remote operation of locking devices for hinged door leaves whereby locking is accomplished by form locking of a slidable bolt, designs are known whereby the bolt of the locking mechanism is brought into the closed position by magnetic forces. Such a locking device can be actuated electrically both in the closed and in the open position. These closing devices for hinged door leaves also have a bolt catch which restrains the hinged door leaf in the door closed position, whereby this engages in a coulisse-shaped recess in the door frame or in the fixed door leaf and thus the bolt catch becomes effective by form locking. This bolt catch can be actuated mechanically directly or indirectly whereby the form locking between the bolt catch and the coulisse-shaped recess is lifted. Non-locked hinged door leaves which are held in the closed position by the bolt catch can only be opened by means of an additional door opening device which can be electrically actuated. For this purpose there are known additional electromagnetically operating door opening devices which are provided in the door frame or in the fixed door leaf. Various electrically actuatable structures are known as door opening devices whereby a closing plate is unlocked by a magnetic field generated via a magnetic coil. After this unlocking the form locking between the bolt catch and the coulisse-shaped recess is lifted.

All known solutions have the disadvantage that the construction costs for the locking and unlocking and for the opening of a hinged door leaf restrained in the closed position are very high. Furthermore, both the door closers and the door openers have many moving parts so that both the door closing and the door opening mechanism have a very high susceptibility to breakdown.

SUMMARY OF THE INVENTION

The aim of the invention is to reduce the susceptibility to breakdown of door opening and closing devices, to lower costs, construction and maintenance expenditure and to ensure secure closing of a hinged door leaf in the closed position and thereafter secure opening.

The problem forming the basis of the invention is to develop a device for hinged door leaves in which both the door closing and restraining device and the door opening device form a structural unit and allow the locking of a hinged door leaf which closes against a door seal whereby the closing and opening device should be capable of being operated remotely.

This problem was solved by the technical characteristics specified in claim 1. The subclaims serve to elaborate the invention.

BRIEF DESCRIPTION OF THE INVENTION

The invention will be explained hereinafter with reference to an example of embodiment and is shown in the relevant drawings.

FIG. 4.2 is a view in a door frame of the electrically active part of the closing and opening device developed according to the invention.

Figure 1:
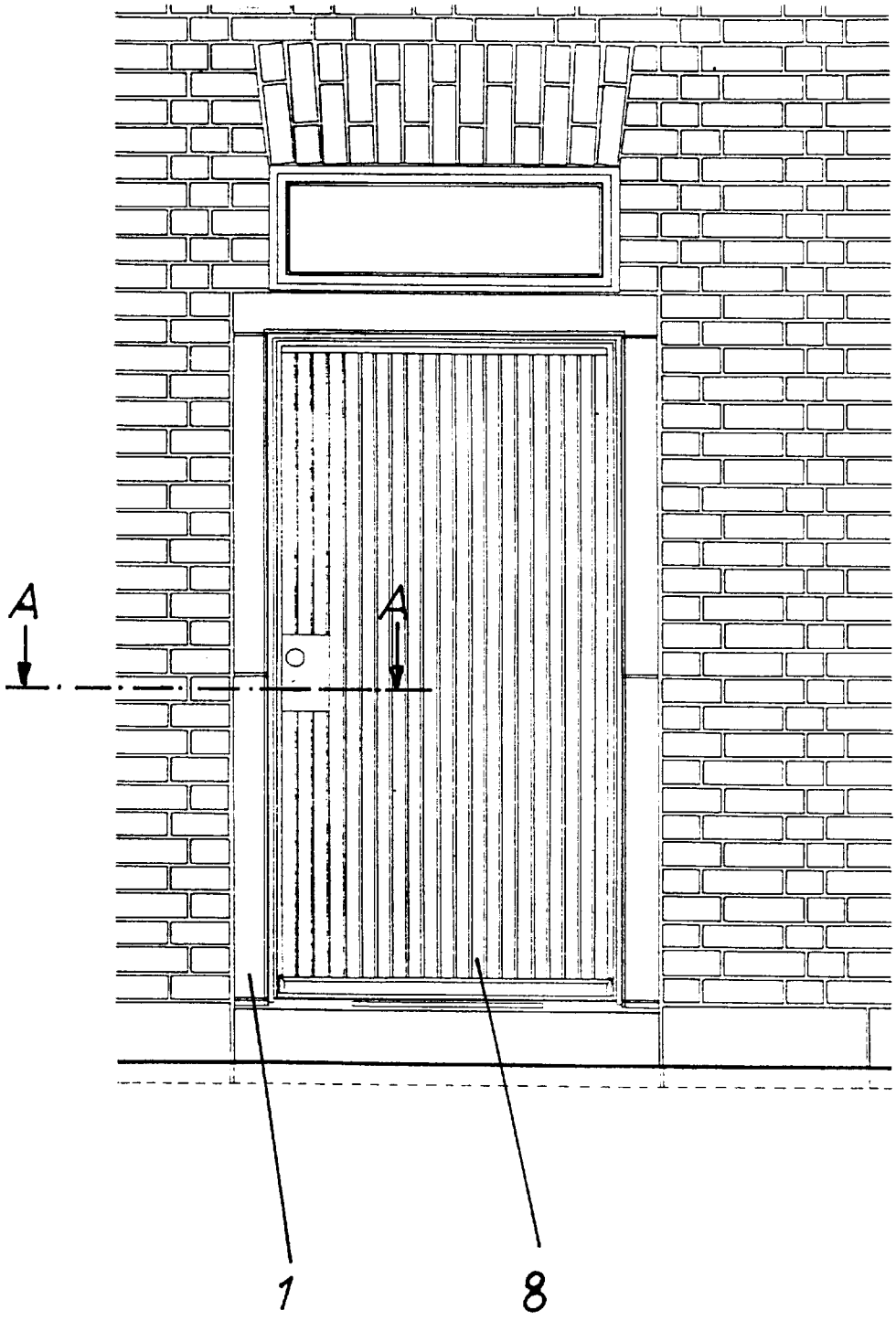
FIG. 1 is a view of an outside door which opens inwards.
Figure 2:
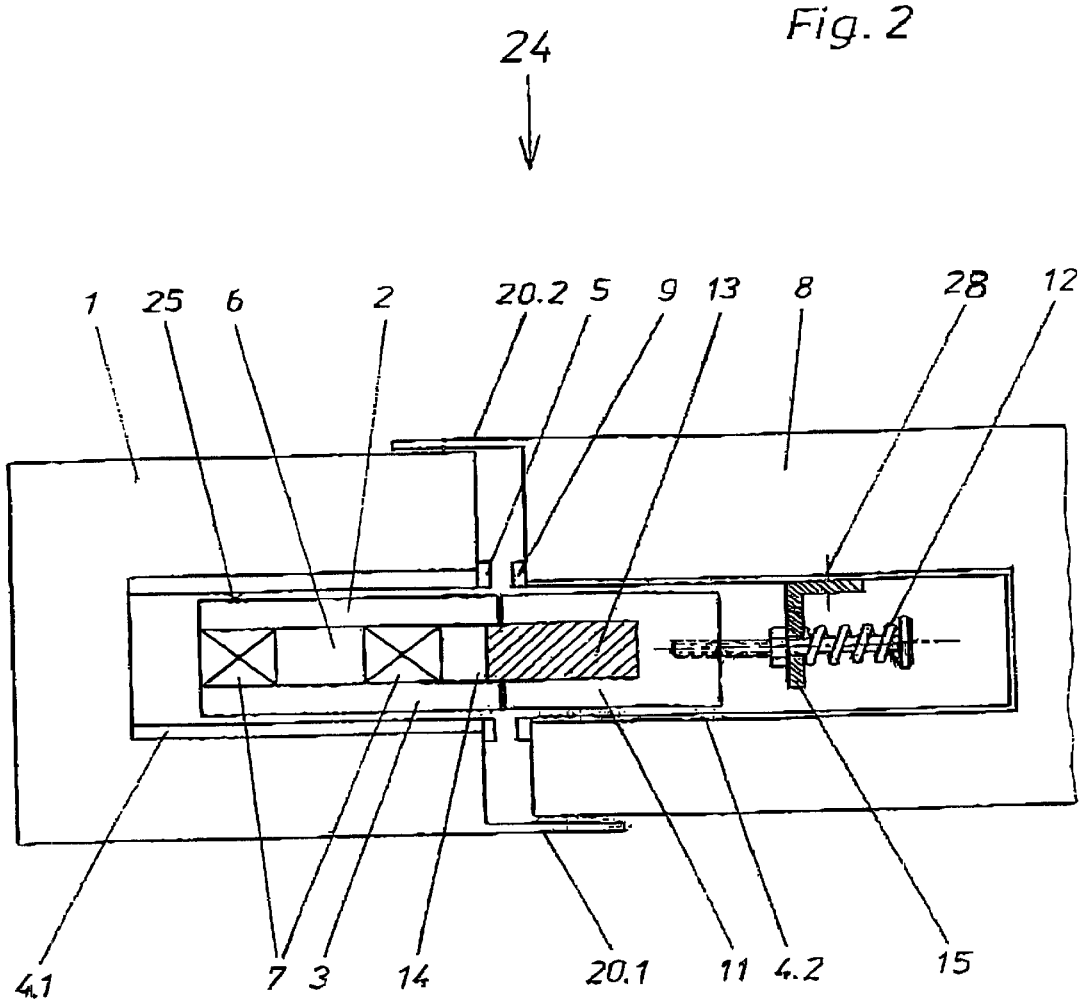
FIG. 2 is a horizontal section A—A as in FIG. 1 through a hinged door leaf in the closed position with a door frame.
Figure 3:
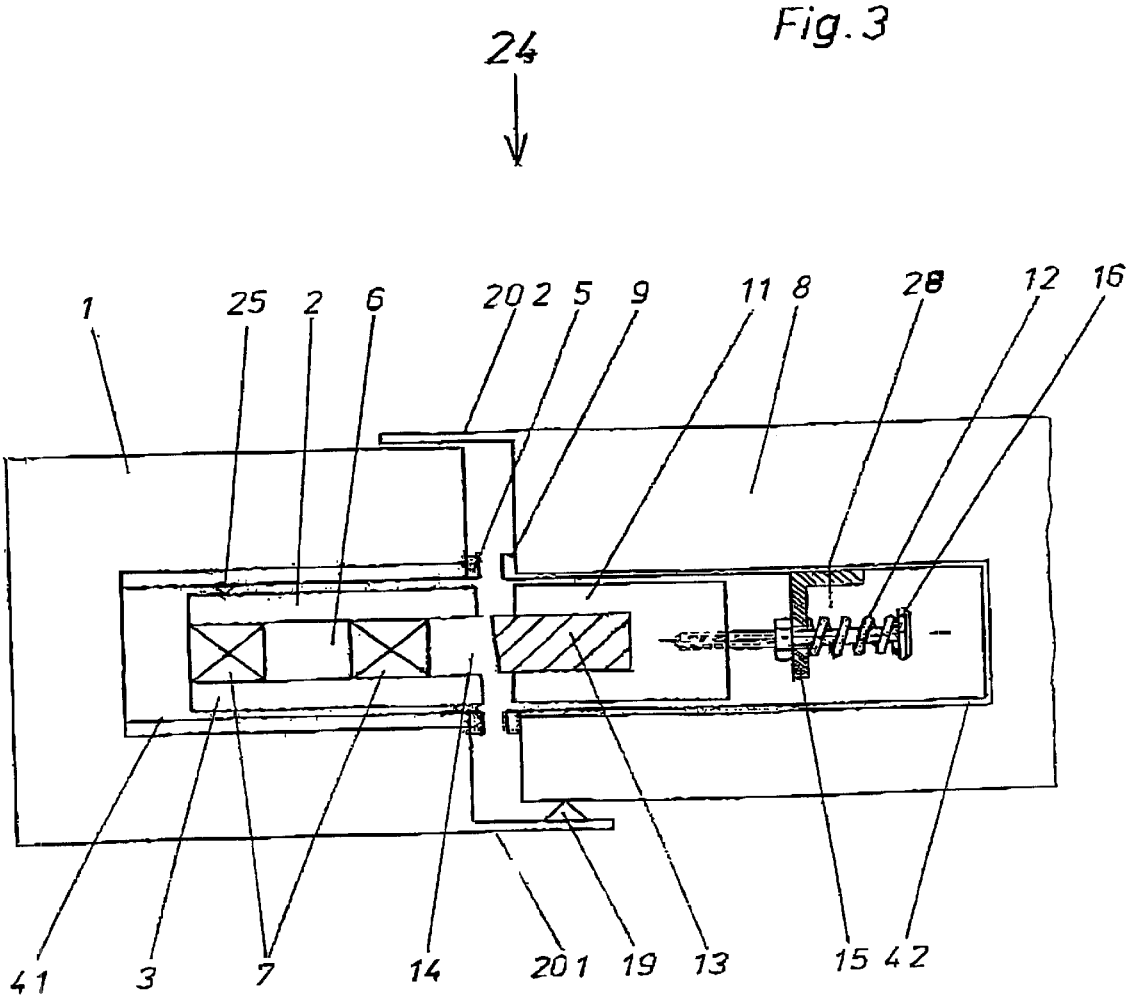
FIG. 3 is a horizontal section A—A as in FIG. 1 through a hinged door leaf closing against a door seal in the closed position FIG. 4.1 is a longitudinal section view through a door frame with a built-in electrically active part of the closing and opening device developed according to the invention.
Figure 5:
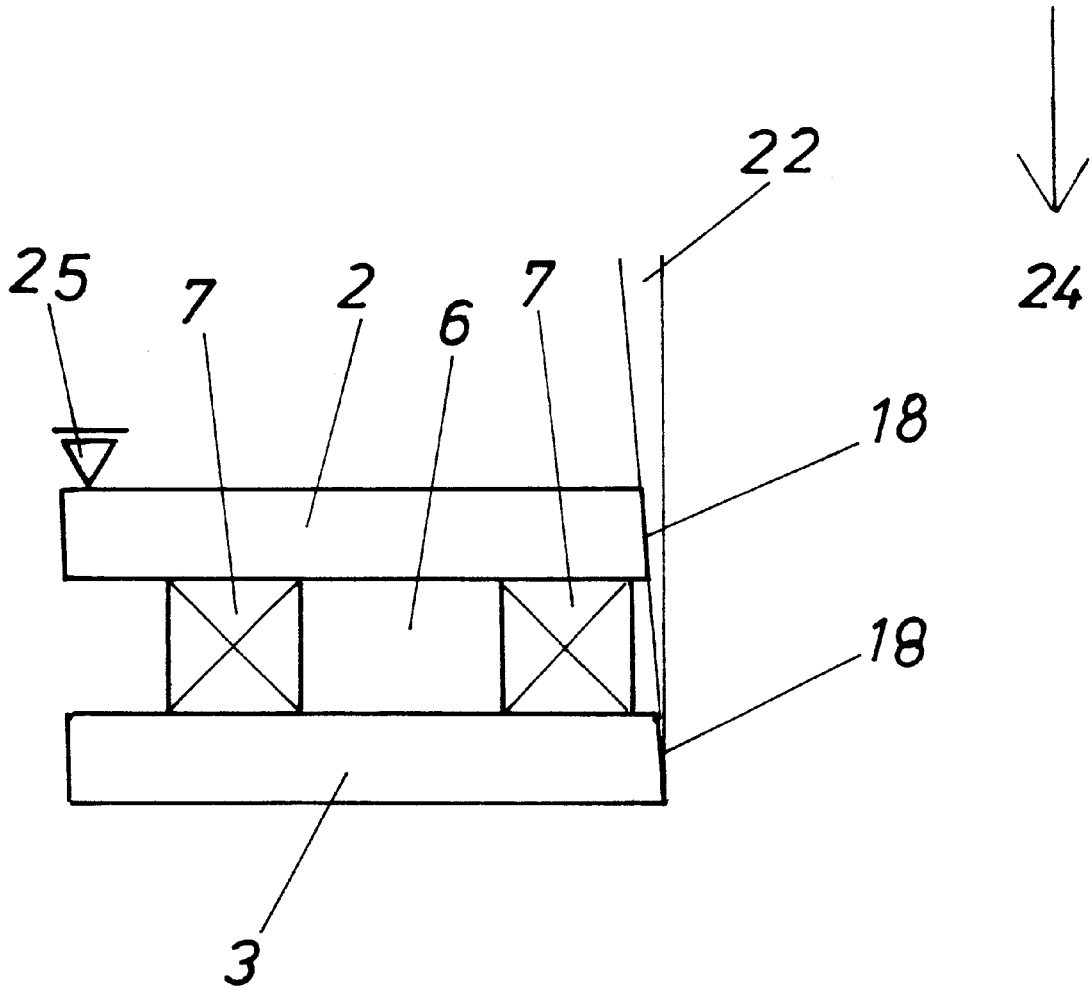

FIG. 5 is the electrically active part in a view B as in FIG. 4

Figure 6A:
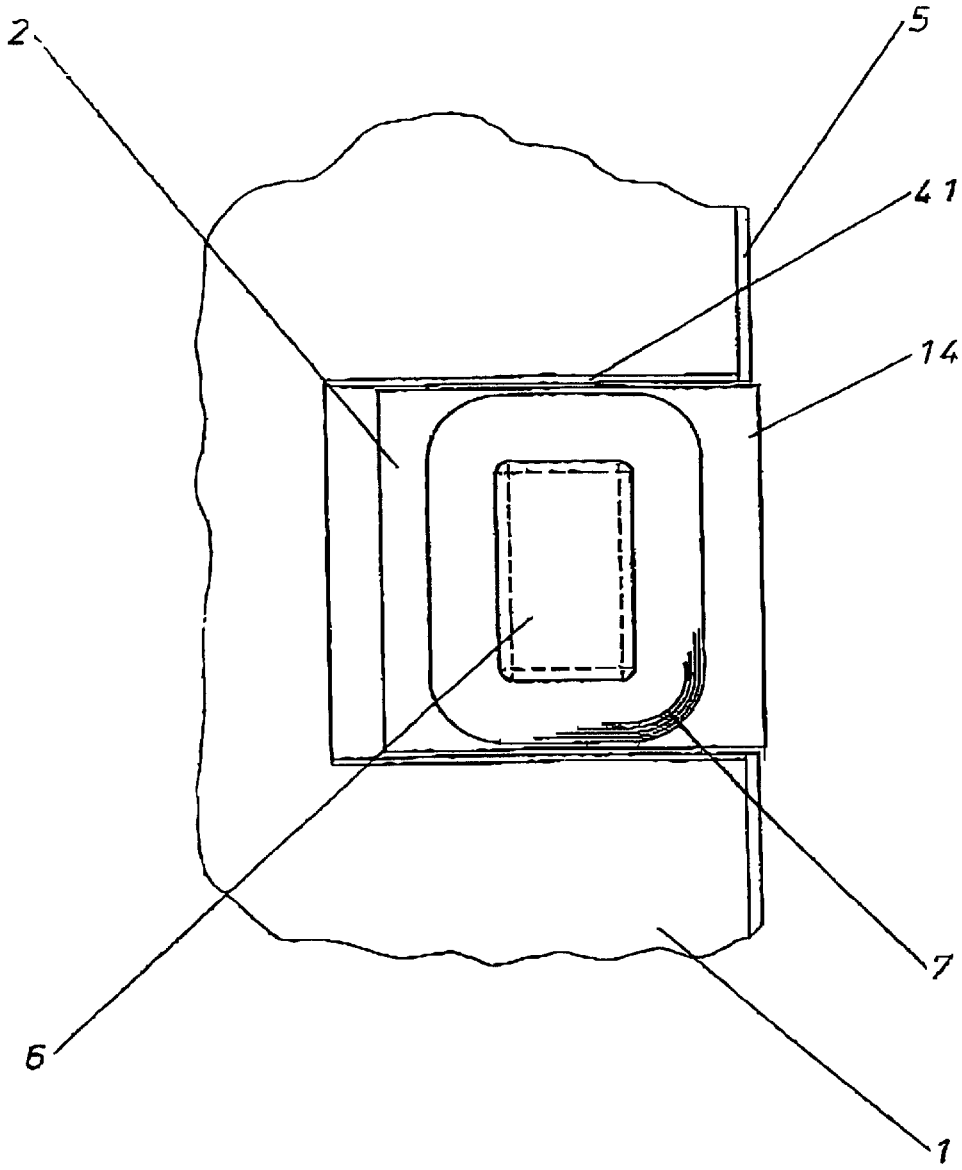

FIG. 6*a* is a magnetic coil in the door frame.

Figure 7:
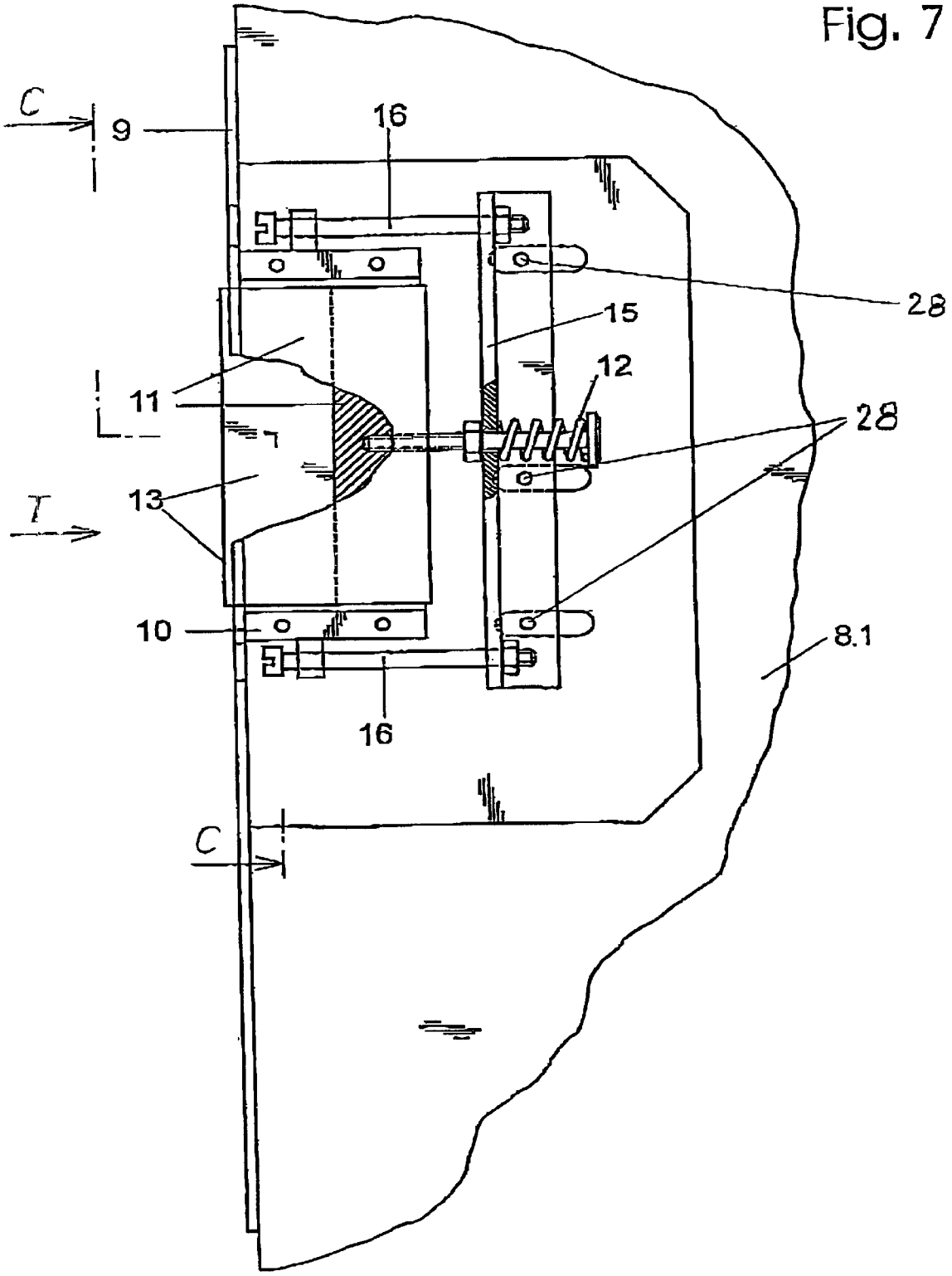
Figure 8:
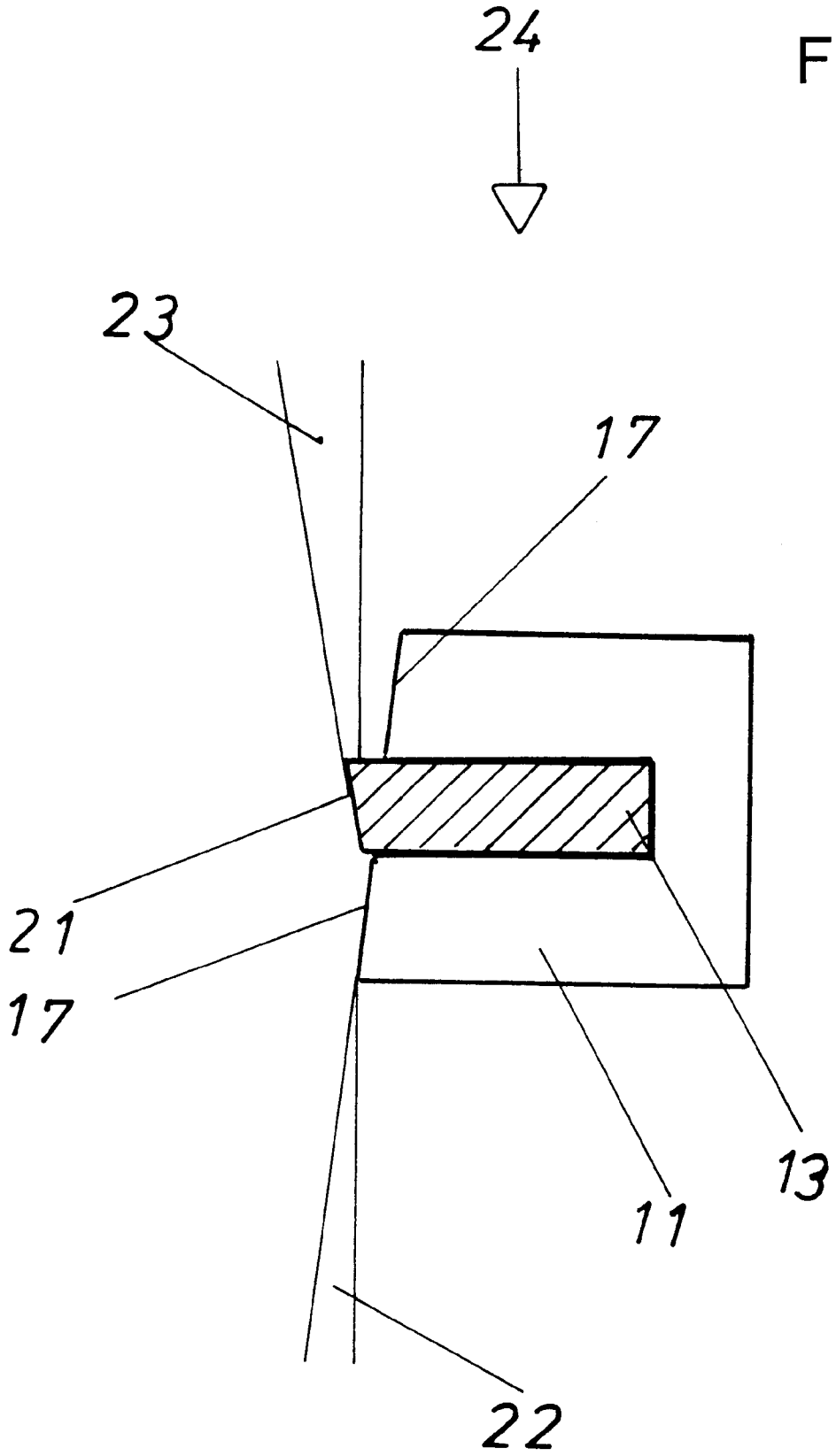
Figure 9:
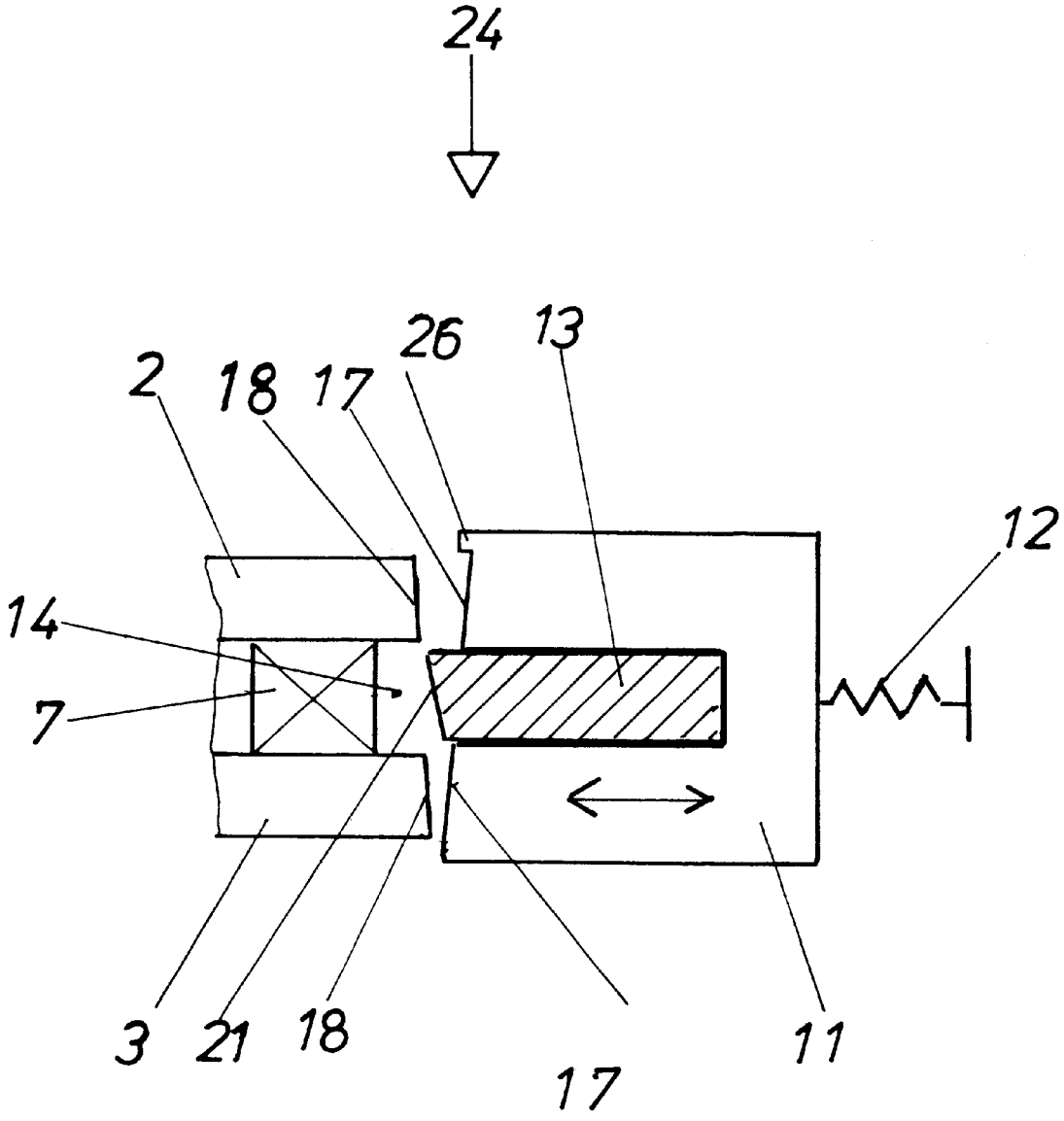

FIG. 7 is a side view of a counterpole piece with intermediate piece built in a frame of a hinged door leaf FIG. 8 is a counterpole piece with intermediate piece in view C as in FIG. 7 with pole plates and intermediate piece of the counterpole piece developed according to the invention FIG. 9 is a counterpole piece in view C as in FIG. 7 with a nose-shaped projection at a pole plate of the counterpole piece developed according to the invention.

Figure 10:
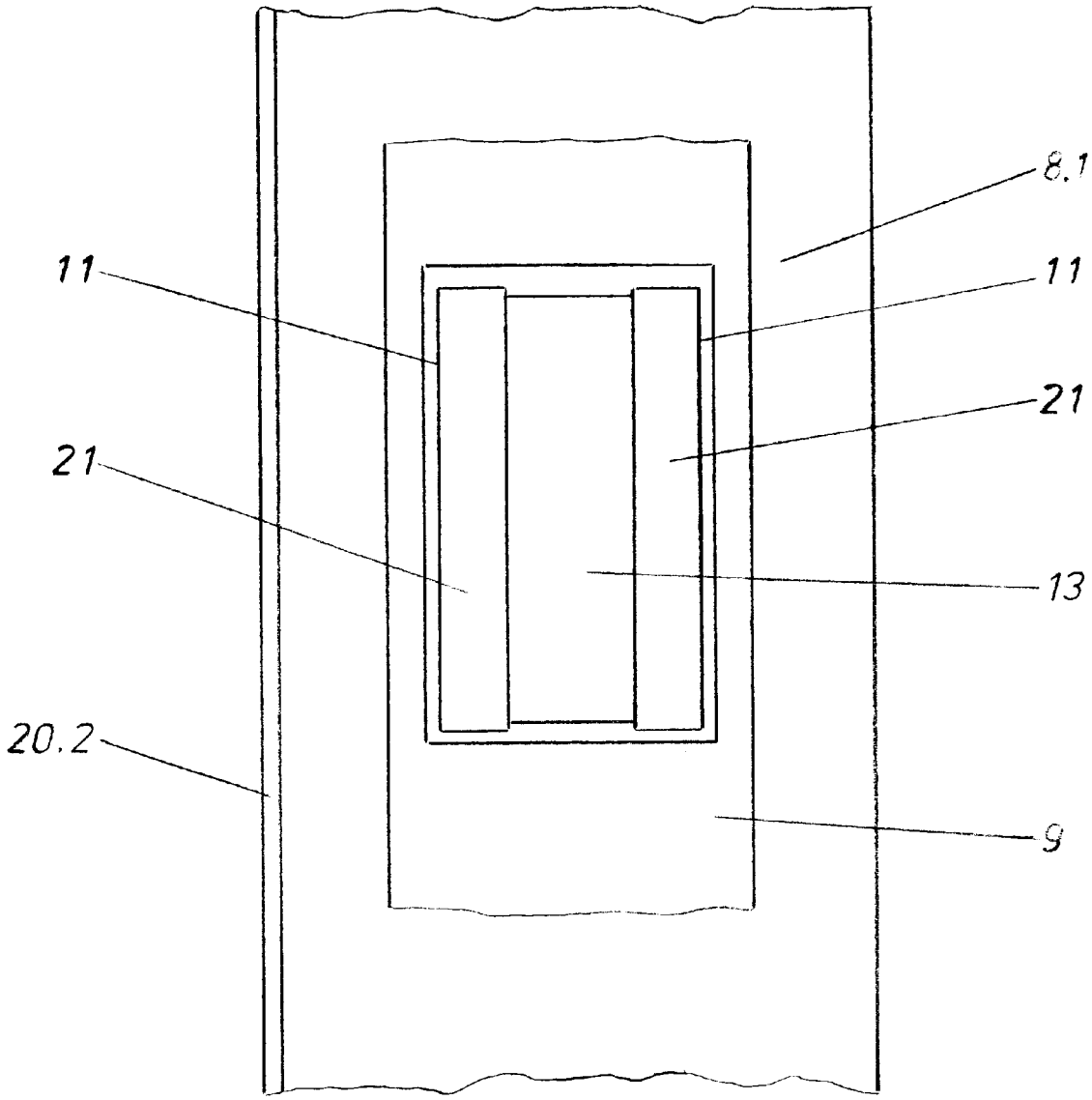

FIG. 10 is a view T on the door leaf as in FIG. 7.

Figure 11:
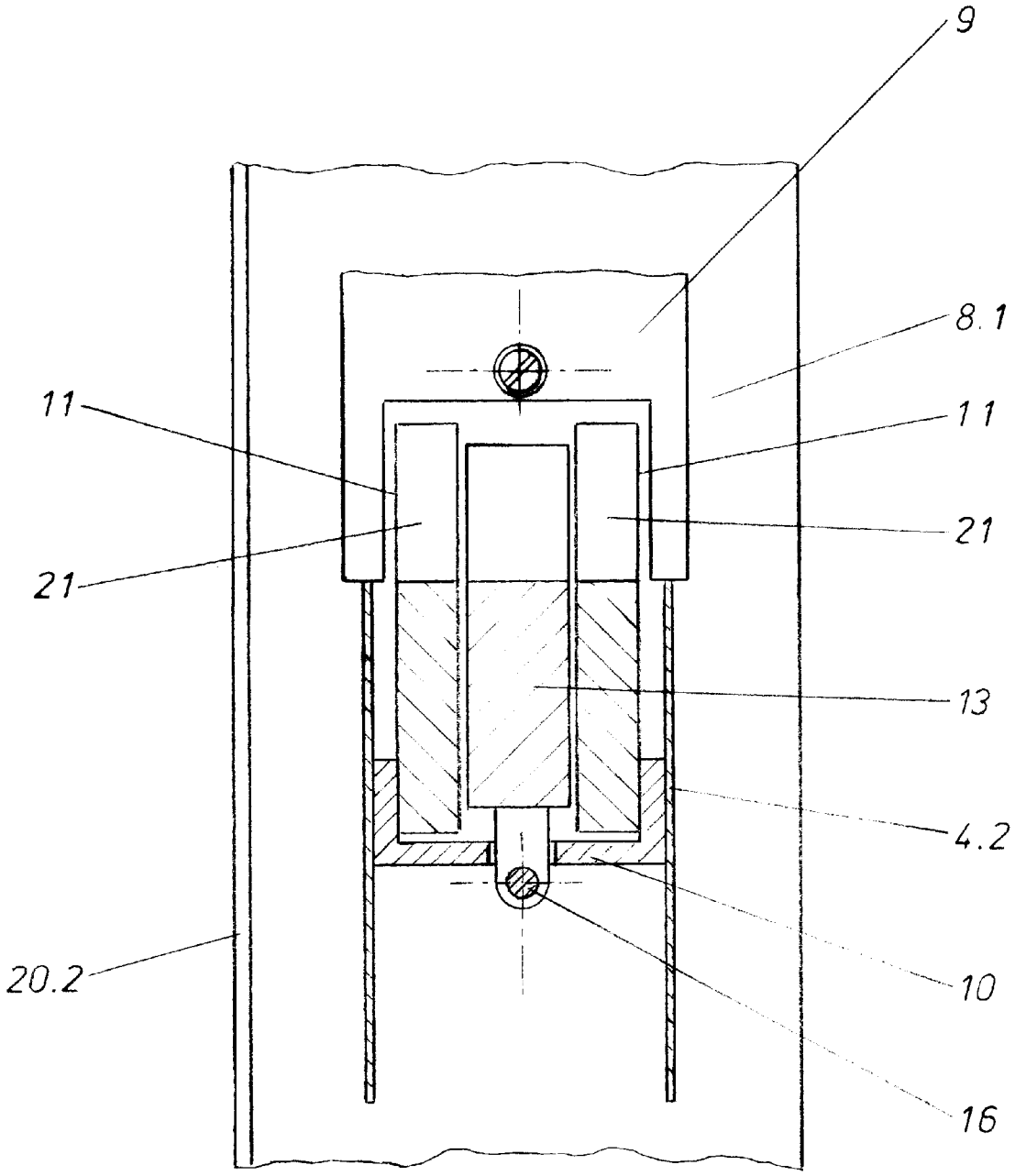

FIG. 11 is a section C—C as in FIG. 7.

DETAILED DESCRIPTION OF THE PREFERRED EMBODIMENTS

In a door frame 1 or in an upright leaf there is installed the electrically active part of an electromagnetic closing and opening device developed according to the invention. This consists of an electromagnetic device having two pole plates 2; 3 which is accommodated in a frame structure 4 whereby this is mounted on a retaining plate 5 made of non-magnetisable material, for example brass.

The electromagnetic device consists of a yoke 6 and a winding 7 surrounding the yoke 6 to produce an electromagnetic field. The yoke 6 is connected by two pole plates 2; 3. These are made of a material which after decay of the electromagnetic field still exhibits a low remanent magnetism.

In the hinged door leaf 8 there is located on the frame side a closing counterpiece for the electrically active part of the electromagnetic closing and opening device provided in the door frame 1 or in the upright leaf. This closing counterpiece consists of a retaining plate 9 made of a non-magnetisable material on which a framework 10 is attached. In said framework there is provided a U-shaped counterpole piece 11 which can slide horizontally to a small extent, which is connected to a return spring 12 provided in the framework 10.

The device designed according to the invention can either be designed as a closing variant or as an opening variant. In the closing variant the counterpole piece 11 is made of soft iron and on application of a voltage to the winding 7 of the electrically active part the closing and opening device comes into a closed position. In the opening variant according to the invention the counterpole piece 11 consists of a permanent magnet and the electrically active part of the closing and opening device according to the invention is used to open a locked door leaf whereby by application of a voltage to the winding 7 of the electrically active part a magnetic field is produced for which like poles lie opposite to those of the permanent magnet. By this means the closing force of the permanent magnet is lifted.

The U-shaped counterpole piece 11 surrounds a recess. In said recess there is inserted an intermediate piece 13 of non-magnetisable material which projects slightly beyond the pole surfaces of the counterpole piece 11, whereby said intermediate piece extends in the direction of the electrically active part of the electromagnetic closing and opening mechanism and there engages in a free space 14 between the pole plates 2; 3 then the door leaf 8 is closed.

In the event of the magnetic field produced by the closing and opening device provided in the door frame 1 being absent in the closing variant or as a result of the production of a homopolar magnetic field, i.e., as a result of the restraining force produced by a permanent magnet being removed in the opening variant, the counterpole piece 11 falls away and said piece is returned to its initial position by the return spring 12. The return spring 12 is provided at the rear end 15 of the framework 10. The closing counterpiece is secured in the hinged door leaf 8 by means of the retaining plate 9 and can be adjusted by means of two set screws 16.

The working principle of the device in the closing variant consists in that, if the hinged door leaf 8 is brought into the closing position, the counterpole surfaces 17 of the counterpole piece 11 come into the region of the electromagnetic field of the electrically active part of the closing and opening device and the counterpole surfaces 17 of the easily movable counterpole piece 11 built into the hinged door leaf 8 are attracted and thereby restrain the hinged door leaf 8 in the closed position such that on the one hand, there arises a force-locking connection between the pole surfaces 18 of the pole plates 2; 3 and the counterpole surfaces 17 of the movable counterpole piece 11 by closure of the electromagnetic field lines and on the other hand, a form locking connection is made by the intermediate piece 13 engaging in a free space 14 between the pole plates 2; 3. In the opening variant the pole surfaces 18 and the counterpole surfaces 17 come into the closed position as a result of the magnetic field of the permanent magnet and in addition to the magnetic restraining force, a form-locking connection is produced by the intermediate piece 13 engaging in a free space 14 between the pole plates 2; 3.

As soon as the hinged door leaf 8 is to close tightly against a door seal 19 located in a door stop 20, i.e., utilizing the elasticity of this door seal 19, the pole surfaces 18 of the pole plates 2; 3, the counterpole surfaces 17 of the counterpole piece 11 and the front surface 21 of the intermediate piece 13 according to the invention have a beveled design with an angle of tilt 22, 23. The angle of tilt 22 for the pole surfaces 18 of the pole plates 2; 3 and for the counterpole surfaces 17 of the counterpole piece 11 in the direction of closure 24 of the door leaf 8 is an acute angle of 1 to 3 degrees, whereby the distance between the pole surfaces 18 and the counterpole surfaces 17 at a position close to the closed position of the door leaf 8 in the door frame 1 is different, i.e., the distance between the pole surface 18 of the pole plate 2 and the counterpole surface 17 of the counterpole piece 11 standing opposite to this is greater than the distance between the pole surface 18 of the pole plate 3 and the counterpole surface 17 of the counterpole piece 11 standing opposite to this. The angle of tilt 23 of the front surface 21 of the intermediate piece 13 is designed as an acute angle in the direction of the door leaf 8 and is likewise 1 to 3 degrees.

This advantageous design of the pole surfaces 18, the counterpole surfaces 17 and the front surface 21 of the intermediate piece 13 has the result that when the magnetic field becomes effective, the hinged door leaf 8 comes into the closed position against the sealing force of the door seal 19 by overcoming the sealing force originating from the elasticity of the door seal 19 and the door leaf can be securely closed. By means of this design of the pole surfaces 18, the counterpole surfaces 17 and the front surface 21 the door leaf is slightly proud, i.e., door frame 1 and door leaf 8 are no longer in a straight line.

The action described is further strengthened by the fact that according to another refinement of the invention the electrically active part consisting of winding 7, yoke 6 and pole plates 2,3 is elastically supported in the frame structure 4 serving as the holder in the door frame 1 and a thrust bearing 25 is provided for this purpose. Likewise the counterpole piece 11 is elastically mounted in the framework 10 provided for this purpose. This elastic supporting or mounting has the result that the pole surfaces 18 and the counterpole surfaces 17 are completely supported after being acted upon by a magnetic field.

Another technical measure to ensure reliable positioning of the counterpole piece 11 in the closing phase in the closed position is provided according to the invention at the counterpole piece 11. Said counterpole piece has a nose-shaped projection 26 at the side of the counterpole piece 11 which is in the opposite direction to the direction of closure. This has the effect that the pole surfaces 18 and the counterpole surfaces 17 can only move onto each other as soon as the closing position is reached.

As soon as in the closing variant no more voltage is applied to the electromagnetic winding 7 or in the opening variant by application of a voltage to the electromagnetic winding 7 to produce a homopolar field, the magnetic field is no longer present as a restraining force and merely a remanent magnetism is active, holding the movable door leaf 8 in the closed position. By means of the released sealing force of the door seal 19 or by means of a slight pushing of the hinged door leaf 8 said door leaf can then be opened since the return spring 12 provided at the rear end of the framework 10 becomes effective and the intermediate piece 13 with the counterpole piece 11 is brought into an initial position by the return spring 12 whereby the intermediate piece 13 no longer engages in the free space 14 between the pole plates 2; 3.

The advantage of the solution according to the invention is that the closing and opening device has no movable parts which are subject to wear or can be impaired by the action of external forces.

The device according to the invention is either actuated by applying a voltage to the electromagnetic winding 7 via remote control provided that the person operating the actuation of the door is inside the building where the electrical switch for the actuation is provided.

Another possibility for actuation of the closing and opening device according to the invention by authorised persons who wish to actuate the hinged door leaf 8 from outside is that the deactivation of the electromagnetic field can either be actuated mechanically via a microswitch not shown, whereby this actuation can be accomplished, for example, via a normal cylinder lock, or by means of a break relay not shown, which is controlled by means of an electronic circuit equipped with a deactivatable identification technology. Known possibilities, e.g. coded magnetic cards or transponders are available as identification technology.

The closing and opening device is activated automatically, controlled by a sensor, for example after the movable door leaf 8 has fallen back into the door stop 20 of the doorframe 1.

| List of reference symbols used |
|---|
| 1 Door frame |
| 2 Pole plate |
| 3 Pole plate |
| 4 Frame structure |
| 5 Retaining plate |
| 6 Yoke |
| 7 Winding |
| 8 Door leaf |
| 9 Retaining plate |
| 10 Framework |
| 11 Counterpole piece |
| 12 Return spring |
| 13 Intermediate piece |
| 14 Free space |
| 15 End |
| 16 Adjusting screw |
| 17 Counterpole surface |
| 18 Pole surface |
| 19 Door seal |
| 20 Doorstop |
| 21 Front surface |
| 22 Angle of tilt |
| 23 Angle of tilt |
| 24 Direction of closure |
| 25 Thrust bearing |

What is claimed is:

1. An electromagnetic device for restraining a hinged door leaf (8) in a closed position with a door frame (1), comprising:

an electrically active part located in said door frame (1), comprising:

two pole plates (2,3) each having a pole surface (18), said pole plates (2,3) being spaced apart by and connected to a yolk (6), wherein said pole plates (2,3) and yolk (6) are accommodated in a frame structure (4) mounted to a retaining plate (5) mounted to said doorframe (1); and a winding (7) wrapped circumferentially around said yolk (6) between said spaced apart pole plates (2,3) where upon an electrical current being supplied to said winding (7) said pole plates (2,3) produce an electromagnetic field; and a closing counterpiece located in said door leaf (8), comprising:

a retaining plate (9) secured to said door leaf (8) and on which a framework (10) is attached;

a return spring (12) provided in and connected to said framework (10);

a slidable, substantially U-shaped counterpole piece (11) having two legs each of which has a counterpole surface (17), wherein said counterpole piece (11) is located within said framework (10) to define a recess and is connected to said return spring (12);

an intermediate piece (13), within said recess, having a portion projecting beyond said counterpole surfaces (17) of said counterpole piece (11);

wherein upon the production of said electromagnetic field, said counterpole surfaces (17) of said counterpole piece (11) are attracted to said pole surfaces (18) of said pole plates (2,3) and said counterpole piece (11) slides toward said electrically active part such that said projecting portion of said intermediate piece (13) engages in a free space (14) between said pole plates (2,3) when said door leaf (8) is in a closed position with said doorframe (1).

2. The electromagnetic device of claim 1, whereupon stopping the supply of said electrical current to said winding (7), said electromagnetic field decays and said counterpole piece (11) slidably retracts to said framework (10) by means of said return spring (12) and said intermediate piece (13) is disengaged from said free space (14) so that said door leaf (8) can be opened from said doorframe (1).

3. An electromagnetic device for restraining a hinged door leaf (8) in a closed position with a door frame (1), comprising:

an electrically active part located in said door frame (1), comprising:

two pole plates (2,3) each having a pole surface (18), said pole plates (2,3) being spaced apart by and connected to a yolk (6), wherein said pole plates (2,3) and yolk (6) are accommodated in a frame structure (4) mounted to a retaining plate (5) mounted to said doorframe (1); and a winding (7) wrapped circumferentially around said yolk (6) between said spaced apart pole plates (2,3) where upon an electrical current being supplied to said winding (7) said pole plates (2,3) produce an electromagnetic field; and a closing counterpiece located in said door leaf (8), comprising:

a retaining plate (9) secured to said door leaf (8) and on which a framework (10) is attached;

a return spring (12) provided in and connected to said framework (10);

a slidable, substantially U-shaped, permanent magnet counterpole piece (11) having two legs each of which has a counterpole surface (17) attracted to said pole surfaces (18) of said pole plates (2,3), wherein said counterpole piece (11) is located within said framework (10) to define a recess and is connected to said return spring (12);

an intermediate piece (13), within said recess, having a portion projecting beyond said counterpole surfaces (17) of said counterpole piece (11) and in locking engagement with a free space (14) between said pole plates (2,3) when said door leaf (8) is in a closed position with said doorframe (1);

wherein upon the production of said electromagnetic field, said counterpole surfaces (17) of said counterpole piece (11) are repelled from said pole surfaces (18) of said pole plates (2,3) and said counterpole piece (11) slides away from said electrically active part such that said projecting portion of said intermediate piece (13) is released from its locking engagement with said free space (14) between said pole plates (2,3).

4. The electromagnetic device of claim 3, whereupon stopping the supply of said electrical current to said winding (7), said electromagnetic field decays and said permanent magnet counterpole piece (11) slidably moves away from said framework (10) toward said pole plates (2,3) and said intermediate piece (13) enters into locking engagement with said free space (14) so that said door leaf (8) is restrained in a closed position with said door-frame (1).

5. The electromagnetic device of claim 1, wherein said retaining plates (5,9) and said intermediate piece (13) are made of a non-magnetizable material.

6. The electromagnetic device of claim 5, wherein said non-magnetizable material is brass.

7. The electromagnetic device of claim 2, wherein upon the decay of said electromagnetic field, said pole plates (2,3) retain a low remnant magnetism.

8. The electromagnetic device as in claim 1 or 3, in which said counterpole surfaces (17) are beveled and have an angle of tilt (22) from 1 to 5 degrees.

9. The electromagnetic device as in claim 1 or 3, in which said portion of said intermediate piece (13) projecting beyond said counterpole surfaces (17) has a beveled front surface (21) having an angle of tilt (23).

10. The electromagnetic device as in claim 1 or 3, in which said pole surfaces (18) are beveled and have an angle of tilt (22) of from 1 to 5 degrees.

11. The electromagnetic device of claim 1, wherein said electrically active part is moveable in the direction of closure of said hinged door leaf (8) and an elastic thrust bearing (25) is provided at one end of said electrically active part inside said door frame (1) facing away from said door leaf (8).

12. The electromagnetic device of claim 11, wherein said electrically active part is rotated about said elastic thrust bearing (25) and a tolerance of 0.5 to 2.0 mm is provided in said retaining plate (5).

13. The electromagnetic device of claim 1, wherein said slidable counterpole piece (11) is elastically supported in said door frame (1) and a tolerance of 0.5 to 2.0 mm to the vertical guide of said counterpole piece (11) is provided in said retaining plate (9) secured to said door leaf (8).

14. The electromagnetic device of claim 1, wherein the counterpole surface (17) of said counterpole piece (11) is provided with a nose-shaped projection (26).

15. The electromagnetic device of claim 1, wherein one of the pole plates (2,3) is provided with a nose-shaped projection (26).

16. The electromagnetic device of claim 1, wherein said retaining plate (5) has a recess for said pole plates (2,3) and said winding (7) and said pole plates (2,3) protrude slightly beyond said retaining plate (5).

17. The electromagnetic device of claim 1, wherein said closing counterpiece is positioned in said door leaf (8) at the same height as said electrically active part located in said door frame (1).

18. The electromagnetic device of claim 1, wherein said pole plates (2,3), yolk (6) and winding (7) are elastically supported in said frame structure (4) by a thrust bearing (25) and said counterpole piece (11) is elastically mounted in said framework (10).

19. The electromagnetic device of claim 1, wherein said yolk (6), winding (7), pole plates (2,3), frame structure (4) and retaining plate (5) form a structural unit.

20. The electromagnetic device of claim 1, wherein said retaining plate (9) secured to said door leaf (8) and on which said framework (10) is attached has a seal with the door profile.

* * * * *